US008226504B1

(12) United States Patent
Lozado

(10) Patent No.: US 8,226,504 B1
(45) **Date of Patent: *Jul. 24, 2012**

(54) BUNTING MAT

(76) Inventor: William Lozado, Sellersburg, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/111,484

(22) Filed: May 19, 2011

Related U.S. Application Data

(63) Continuation of application No. 12/646,396, filed on Dec. 23, 2009, now Pat. No. 7,951,019.

(51) Int. Cl.
*A63B 69/00* (2006.01)

(52) U.S. Cl. ..... 473/452; 473/451; 473/422

(58) Field of Classification Search ..... 473/422, 473/431, 437, 450, 451, 453, 457, 458, 464, 473/564, 452, 278, 270; D21/780
See application file for complete search history.

(56) References Cited

U.S. PATENT DOCUMENTS

| | | | | |
|---|---|---|---|---|
| 3,342,487 | A * | 9/1967 | David | 473/452 |
| 3,353,824 | A * | 11/1967 | Hamson, Jr. | 473/458 |
| 3,813,097 | A * | 5/1974 | Darby | 473/490 |
| 4,050,694 | A * | 9/1977 | Domroski | 473/429 |
| 4,166,617 | A | 9/1979 | de Jesus | |
| 4,309,031 | A * | 1/1982 | O'Meara | 473/415 |
| 4,932,656 | A | 6/1990 | Pierce | |
| 5,246,228 | A | 9/1993 | Hope, II | |
| 5,330,176 | A * | 7/1994 | Cagney, Jr. | 473/452 |
| 5,607,150 | A * | 3/1997 | Schnorr, III | 473/499 |
| 5,947,833 | A * | 9/1999 | Alward | 473/218 |
| D418,569 | S * | 1/2000 | Murphy | D21/780 |
| 6,386,996 | B1 | 5/2002 | Foster | |
| D514,644 | S | 2/2006 | Henning | |
| 7,059,862 | B2 * | 6/2006 | McGinley | 434/247 |
| 7,090,599 | B2 | 8/2006 | Hedgepath | |
| D568,956 | S * | 5/2008 | Wilson | D21/780 |
| D593,177 | S * | 5/2009 | Litterio | D21/780 |
| 7,534,177 | B2 | 5/2009 | Henning | |
| D595,382 | S * | 6/2009 | Richard | D21/780 |
| D634,385 | S * | 3/2011 | Parrish, Jr. | D21/780 |
| 7,951,019 | B1 * | 5/2011 | Lozado | 473/451 |
| 2006/0030435 | A1 * | 2/2006 | Opdyke | 473/453 |
| 2006/0211522 | A1 | 9/2006 | Hapanowicz | |
| 2008/0102993 | A1 | 5/2008 | Jackson | |
| 2008/0305893 | A1 | 12/2008 | Repko, Jr. | |
| 2009/0233737 | A1 * | 9/2009 | Lerch | 473/452 |
| 2009/0253529 | A1 | 10/2009 | Giusti | |

FOREIGN PATENT DOCUMENTS

| | | |
|---|---|---|
| GB | 2398019 | 11/2004 |

* cited by examiner

*Primary Examiner* — Mitra Aryanpour
(74) *Attorney, Agent, or Firm* — Robert H. Eichenberger; Scott W. Higdon; Middleton Reutlinger

(57) ABSTRACT

Disclosed herein are various inventive methods and apparatus related to an apparatus and method for teaching bunting techniques to baseball or softball players. A bunting mat may be provided that contains a plurality of lines that aide a player in better understanding bunting techniques, including aiding a player with appropriately positioning their feet for a bunt.

16 Claims, 12 Drawing Sheets

BUNTING MAT

CROSS REFERENCE TO RELATED APPLICATIONS

This application is a continuation of U.S. patent application Ser. No. 12/646,396, now U.S. Pat. No. 7,951,019, filed Dec. 23, 2009 and entitled "Bunting Mat."

TECHNICAL FIELD

The present invention is directed generally to an apparatus for teaching bunting techniques. More particularly, various inventive methods and apparatus disclosed herein relate to a bunting mat for teaching bunting techniques to softball and/or baseball players.

BACKGROUND

Bunting is a well known offensive technique utilized in various situations in baseball and softball. According to the Little League Rule Book, a bunt is a batted ball not swung at, but intentionally met with the bat and tapped slowly. When bunting, a hitter may hold the bat over and/or in front of home plate and intentionally tap the ball into play. One type of bunt is a sacrifice bunt, wherein the batter bunts the ball into play with the intention of advancing a base runner, and in anticipation of the batter being thrown out. Other types of bunts are also known such as, for example, the drag bunt and the squeeze play bunt.

SUMMARY

The present disclosure is directed to inventive methods and apparatus for teaching bunting techniques, and, more specifically, various inventive methods and apparatus disclosed herein relate to a bunting mat for teaching bunting techniques. For example, in certain embodiments a bunting mat may be provided that contains a plurality of lines that aide a player in better understanding bunting techniques, including aiding a player with positioning his or her feet within a batter's box and aiding a player with appropriately positioning his or her bat.

Generally, in one aspect, an apparatus for teaching bunting techniques comprises a mat defining a forward direction, a rearward direction opposite the forward direction, a right direction perpendicular to the forward direction and the rearward direction, and a left direction opposite the right direction. The apparatus further comprises a depiction of a target, for example, a home plate, provided on the mat, a strike zone width extending over the target and in a forward direction in front of the target, and a predetermined clock center point in the strike zone width. The clock center point is in the forward direction in front of the target. The forward direction generally defines a twelve o'clock orientation with respect to the clock center point. The apparatus further comprises a one o'clock fiducial marking provided on the mat across the strike zone width in front of the target. The one o'clock fiducial marking extends generally in an eight o'clock to one o'clock orientation with respect to the clock center point. The apparatus further comprises a two o'clock fiducial marking provided on the mat across the strike zone width and spaced apart from the one o'clock fiducial marking. The two o'clock fiducial marking is provided more proximal the target than the one o'clock fiducial marking and extends generally in a seven o'clock to two o'clock orientation with respect to the clock center point. The apparatus further comprises an eleven o'clock fiducial marking provided on the mat across the strike zone width in front of the target and extending generally in a four o'clock to eleven o'clock orientation with respect to the clock center point. The apparatus further comprises a ten o'clock fiducial marking provided on the mat across the strike zone width spaced apart from the eleven o'clock fiducial marking. The ten o'clock fiducial marking is provided more proximal the target than the eleven o'clock fiducial marking and extends generally in a five o'clock to ten o'clock orientation with respect to the clock center point.

In some embodiments at least one of the one o'clock fiducial marking and the two o'clock fiducial marking intersects at least one of the ten o'clock fiducial marking and the eleven o'clock fiducial marking. In some versions of those embodiments at least one of the one o'clock fiducial marking, the two o'clock fiducial marking, the ten o'clock fiducial marking, and the eleven o'clock fiducial marking is a continuous line.

In some embodiments the two o'clock fiducial marking passes immediately adjacent the periphery of the target.

In some embodiments the two o'clock fiducial marking passes over the target.

In some embodiments the apparatus further comprises at least a portion of a left-handed batter's box in the right direction from the target and at least a portion of a right-handed batter's box in the left direction from the target. The portion of the left-handed batter's box and the portion of the right-handed batter's box flank the strike zone width. In some versions of these embodiments the one o'clock fiducial marking and the two o'clock fiducial marking extend into the right-handed batter's box and the ten o'clock fiducial marking and the eleven o'clock fiducial marking extend into the left-handed batter's box. In some versions of these embodiments the apparatus further comprises an arcuate fiducial marking extending between the left-handed batter's box and the right-handed batter's box in front of the clock center point. The arcuate fiducial marking may be concave as viewed from the clock center point.

Generally, in another aspect, an apparatus for teaching bunting techniques comprises a mat defining a forward direction, a rearward direction opposite the forward direction, a right direction perpendicular to the forward direction and the rearward direction, and a left direction opposite the right direction. The apparatus further comprises at least a portion of a left-handed batter's box and at least a portion of a right-handed batter's box provided on the mat. The left-handed batter's box and the right-handed batter's box are spaced apart from one another and generally flank a strike zone width of the mat. The right-handed batter's box has a right-handed interior fiducial marking and a right-handed front fiducial marking perpendicular to the right-handed interior fiducial marking. The right-handed interior fiducial marking is adjacent the strike zone width and generally oriented along the forward direction and the rearward direction. The right-handed front fiducial marking extends in the left direction away from the strike zone width. The left-handed batter's box has a left-handed interior fiducial marking and a left-handed front fiducial marking perpendicular to the left-handed interior fiducial marking. The left-handed interior fiducial marking is adjacent the strike zone width and generally oriented along the forward direction and the rearward direction. The left-handed front fiducial marking extends in the right direction away from the strike zone width. The left-handed interior fiducial marking is substantially parallel with the right handed interior fiducial marking and the left-handed front fiducial marking is substantially collinear with the right-handed front fiducial marking. The apparatus further comprises a predetermined imaginary clock center point in the strike zone width generally equidistant between the left-handed interior fiducial marking and the right-handed interior fiducial marking. The portion of the right-handed interior fiducial marking most proximal the right-handed front fiducial marking generally defines a ten o'clock orientation with respect to the clock center point. The portion of the left-handed interior fiducial marking most proximal the right-handed front fiducial marking generally defines a two o'clock orientation with respect to the clock center point. The apparatus further comprises a one o'clock fiducial marking provided on the mat extending across the strike zone width from the right-handed batter's box generally in an eight o'clock to one o'clock orientation with respect to the clock center point. The apparatus further comprises a two o'clock fiducial marking provided on the mat spaced apart form the one o'clock fiducial marking. The two o'clock fiducial marking extends across the strike zone width from the right-handed batter's box generally in a seven o'clock to two o'clock orientation with respect to the clock center point. The apparatus further comprises an eleven o'clock fiducial marking extending across the strike zone width from the left-handed batter's box generally in a four o'clock to eleven o'clock orientation with respect to the clock center point. The apparatus further comprises a ten o'clock fiducial marking provided in the strike zone spaced apart from the eleven o'clock fiducial marking. The ten o'clock fiducial marking extends across the strike zone width from the left-handed batter's box generally in a five o'clock to ten o'clock orientation with respect to the clock center point.

In some embodiments the one o'clock fiducial marking, the two o'clock fiducial marking, the ten o'clock fiducial marking, and the eleven o'clock fiducial marking each include a plurality of sequential substantially aligned shapes.

In some embodiments the apparatus further comprises an arcuate fiducial marking connecting the one o'clock, the two o'clock, the ten o'clock, and the eleven o'clock fiducial markings proximal forward direction ends thereof. The arcuate fiducial marking may be concave as viewed from the clock center point.

In some embodiments the apparatus further comprises a target in the depiction of a home plate provided on the mat in the strike zone width offset in the rearward direction from the clock center point. The home plate may be at least mostly interposed between the two o'clock fiducial marking and the ten o'clock fiducial marking. In some versions of these embodiments the home plate has a front home plate fiducial marking wholly interposed between the two o'clock fiducial marking and the ten o' clock fiducial marking.

In some embodiments the mat is configured for placement adjacent a home plate having a front side, such that the majority of the front side extends between the two o'clock fiducial marking and the ten o'clock fiducial marking.

In some embodiments the one o'clock fiducial marking is parallel with the two o'clock fiducial marking.

In some aspects the apparatus for teaching bunting techniques may comprises a mat and a home plate provided on the mat. The home plate is more generally referred to as a target, it being understood that the target is the item at which the pitcher aims, and it is the thing that defines the width of the strike zone. The target could be any shape or any representation of anything at which a pitcher could aim. So, the target can be a true home plate, but it need not be. If it is a home plate, any representation of home plate is acceptable. Obviously, however, because baseball is known the world over, there is a standard representation of home plate that is universally accepted. Therefore, for the sake of description and depictions of certain embodiments herein, the universally accepted depiction of home plate will be utilized. The depicted home plate includes a substantially flat front side, a right side extending rearwardly and generally perpendicularly from a first end of the flat front side, and a left side extending rearwardly and generally perpendicularly from a second end of the front side. The front side of the home plate generally faces a forward direction.

Generally, in another aspect, the apparatus for teaching bunting techniques comprises a mat defining a forward direction, a rearward direction opposite the forward direction, a right direction perpendicular to the forward direction and the rearward direction, and a left direction opposite the right direction. The apparatus further comprises a depiction of a home plate provided on the mat. The home plate includes a home plate front fiducial marking extending in an orientation from the right direction to the left direction and defining a strike zone width. The apparatus further comprises a right-handed batter's box having a right-handed front fiducial marking in front of the home plate and to the left of the strike zone width. The right-handed front fiducial marking is generally oriented in a left to right orientation. The apparatus further comprises a left-handed batter's box having a left-handed front fiducial marking in front of the home plate and to the left of the strike zone width. The left-handed front fiducial marking is generally oriented in a left to right orientation. The apparatus further comprises a first fiducial marking extending from the right-handed batter's box generally in the forward direction and the right direction at approximately a forty to fifty degree angle with respect to the home plate front fiducial marking. The first fiducial marking passes adjacent to a left end of the home plate front fiducial marking. The apparatus further comprises a second fiducial marking in spaced relation to the first fiducial marking and being at approximately a zero to ten degree angle with respect to the first fiducial marking. The second fiducial marking may be more distal the home plate than the first fiducial marking and extend from the right-handed batter's box. The apparatus further comprises a third fiducial marking extending from within the left-handed batter's box generally in the forward direction and the left direction at approximately a forty to fifty degree angle with respect to the home plate front fiducial marking. The third fiducial marking may pass adjacent to a right end of the home plate front fiducial marking. The apparatus further comprises a fourth fiducial marking in spaced relation to the third fiducial marking and being at approximately a zero to ten degree angle with respect to the third fiducial marking. The second fiducial marking may be more distal the home plate than the fourth fiducial marking and extend from the left-handed batter's box.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention.

Figure 1:
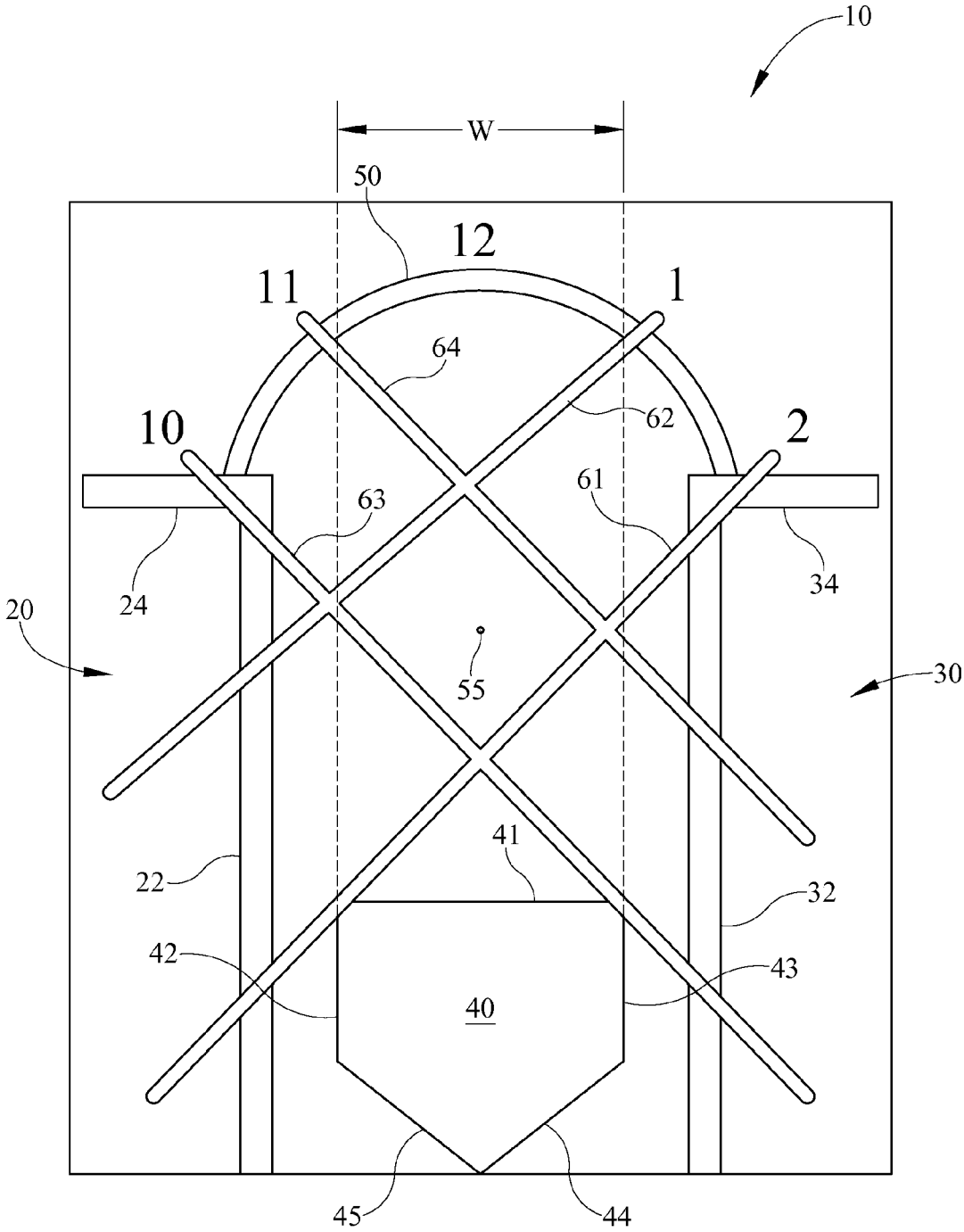
FIG. 1 illustrates a first embodiment of an apparatus for teaching bunting techniques.

Referring now to FIG. 1 through FIG. 12, various embodiments of methods and apparatus for teaching bunting techniques are described in detail. Referring initially to FIG. 1, a first embodiment of an apparatus for teaching bunting techniques is shown. The apparatus includes a mat 10. In some embodiments the mat 10 may be manufactured from a synthetic turf-like material such as, for example, astro-turf. In some embodiments the mat 10 may be manufactured from a plastic material such as, for example, a heavy duty vinyl sign or banner stock. The various elements described and depicted on the mat 10 may be any of a number of materials and may be coupled to the mat 10 in any of a number of ways, as will be apparent to one of skill in the art. For example, in some embodiments some or all of the various elements may be painted on the mat 10 and/or manufactured from a material dyed differently than other portions of the mat 10. Also, for example, in some embodiments some or all of the various elements may be adhered (such as, for example, using tape, glue, static attraction, magnetic attraction, and the like) to the mat 10. Also, for example, in some embodiments some or all of the various elements may be removably coupled to the mat 10 using, for example, a hook and loop fastener.

The mat 10 shown in FIG. 1 has a right-handed batter's box 20 and a left-handed batter's box 30 in spaced relation to one another. The right-handed batter's box 20 has a right-handed interior line 22 extending along the mat in a forward to rearward direction. The forward direction is the direction, with respect to a target such as home plate 40, that would be toward a pitcher or pitching machine when balls are being thrown to a player utilizing the mat 10. The rearward direction is opposite the forward direction and is the direction that would be toward a catcher if a catcher were present catching balls from the pitcher. A right-handed front line 24 extends from the right-handed interior line 22 in a left direction. The left direction is perpendicular to the forward and rearward direction and is toward where a right-handed batter would stand. The right-handed front line 24 defines the front of the right-handed batter's box 20 and extends in a direction away from the left-handed batter's box 30. The left-handed batter's box 30 has a left-handed interior line 32 extending along the mat in a forward to rearward direction of the mat 10. A left-handed second front line 34 extends from the right-handed interior line 32 in a right direction opposite the left direction. The left-handed front line 34 defines the front of the left-handed batter's box 30 and extends in a direction away from the right-handed batter's box 20.

The left-handed batter's box 30 and the right-handed batter's box 20 flank a target, such as home plate 40. The universally known shape for home plate 40 includes a front side 41, a right side 43 extending rearwardly and perpendicularly from an end of the front side 41, and a left side 42 extending rearwardly and generally perpendicularly from an opposite end of the front side 41. A right angled portion 44 extends inwardly and rearwardly from the right side 43 toward a left angled portion 45 that extends inwardly and rearwardly from the left side 42. The front side 41 generally faces the forward direction, e.g., toward the pitcher. A strike zone width W, extends from the right side 43 to the left side 42 of the home plate 40 forward of the home plate 40. A center point 55 of an imaginary analog clock face is located forward of the home plate 40 and generally equidistant between first direction interior line 22 and first direction interior line 32. Although the clock center point 55 is shown as a mark on the embodiment of FIG. 1, in other embodiments the clock center point 55 will not be represented by a physical mark or object. In some embodiments, as will be described in additional detail herein, the clock center point 55 may define a reference point about which fiducial markings such as a first line 61, a second line 62, a third line 63, and a fourth line 64 are arranged.

The first line 61 extends from within the right-handed batter's box 20 in a generally forward right direction generally toward the left-handed batter's box 30 at approximately a forty to fifty degree angle, preferably approximately forty-five degrees, with respect to the front side 41 of the home plate 40. The first line 61 passes over a left intersection of the front side 41 and the left side 42 of the home plate 40. In one embodiment, the first line 61 also passes over the intersection between the left-handed first direction interior line 32 and the left-handed front second direction line 34. With respect to the clock center point 55, the first line 61 runs generally in a seven o'clock to two o'clock orientation. That is, if the clock center point 55 were the center of an analog clock face, with the six o'clock direction being toward the intersection of right angled portion 44 and left angled portion 45, the first line 61 would be oriented generally along a line extending between the two o'clock and seven o'clock locations on the clock face. The first line 61 may be referenced as a two o'clock line herein and the mat 10 may optionally include the numeral "2" at a forward end of the first line 61, as depicted in FIG. 1.

The second line 62 is in spaced relation to the first line 61 and is at approximately a zero to ten degree angle with respect thereto. In the depicted embodiment, the second line 62 and the first line 61 are at an approximately five degree angle with respect to one another and are converging toward one another as they move from the right-handed batter's box 20 toward the direction of the left-handed batter's box 30. In other embodiments the second line 62 and the first line 61 may be parallel, or may converging toward one another at a different angle, or may be diverging away from one another as they move from the right-handed batter's box 20 toward the direction of the left-handed batter's box 30. The second line 62 is more distal the home plate 40 than the first line 61. The second line 62 extends from within the right-handed batter's box 20 toward a location forward and beyond the intersection between the left-handed first direction interior line 32 and the left-handed front second direction line 34. With respect to the clock center point 55, the second line 62 runs generally in an eight o'clock to one o'clock orientation. The second line 62 may be referenced as a one o'clock line herein and the mat 10 may optionally include the numeral "1" at a forward end of the second line 62, as depicted in FIG. 1.

The third line 63 extends from within the left-handed batter's box 30 in a generally forward left direction generally toward the right-handed batter's box 20 at approximately a forty to fifty degree angle, preferable a forty-five degree angle with respect to the front side 41 of the home plate 40. The third line 63 passes over a right intersection of the front side 41 and the right side 43 of the home plate 40. The third line 63 also passes over the intersection between the right-handed interior line 22 and the right-handed front line 24. With respect to the clock center point 55, the third line 63 runs generally in a five o'clock to ten o'clock orientation. The third line 63 may be referenced as a ten o'clock line herein and the mat 10 may optionally include the numeral "10" at a forward end of the third line 63, as depicted in FIG. 1.

The fourth line 64 is in spaced relation to the third line 63 and is at a zero to ten degree angle, preferably an approximately zero degree angle with respect to the third line 63. In the depicted embodiment, the fourth line 64 and the third line 63 are at a zero degree angle with respect to one another. In some embodiments the fourth line 64 and the third line 63 may converge toward or diverge away from one another as they move from the left-handed batter's box 30 toward the right-handed batter's box 20. The fourth line 64 is more distal the home plate 40 than the third line 63. The fourth line 64 extends from within the left-handed batter's box 30 toward a location forward and beyond the intersection between the right-handed interior line 22 and the right-handed front line 24. With respect to the clock center point 55, the fourth line 64 runs generally in an eleven o'clock to four o'clock orientation. The fourth line 64 may be referenced as an eleven o'clock line herein and the mat 10 may optionally include the numeral "11" at a forward end of the fourth line 64, as depicted in FIG. 1.

In some embodiments, an arc line 50 is provided in a forward portion of the mat 10 and extends between a location proximal the intersection between the right-handed interior line 22 and the right-handed front line 24 and the intersection between the left-handed first direction interior line 32 and the left-handed front line 34. The arc line 50 extends between and connects the first line 61, the second line 62, the third line 63, and the fourth line 64. In some embodiments the arc line 50 may serve as a visual aide to help a batter be appropriately oriented to the first line 61, the second line 62, the third line 63, and the fourth line 64.

Figure 3:
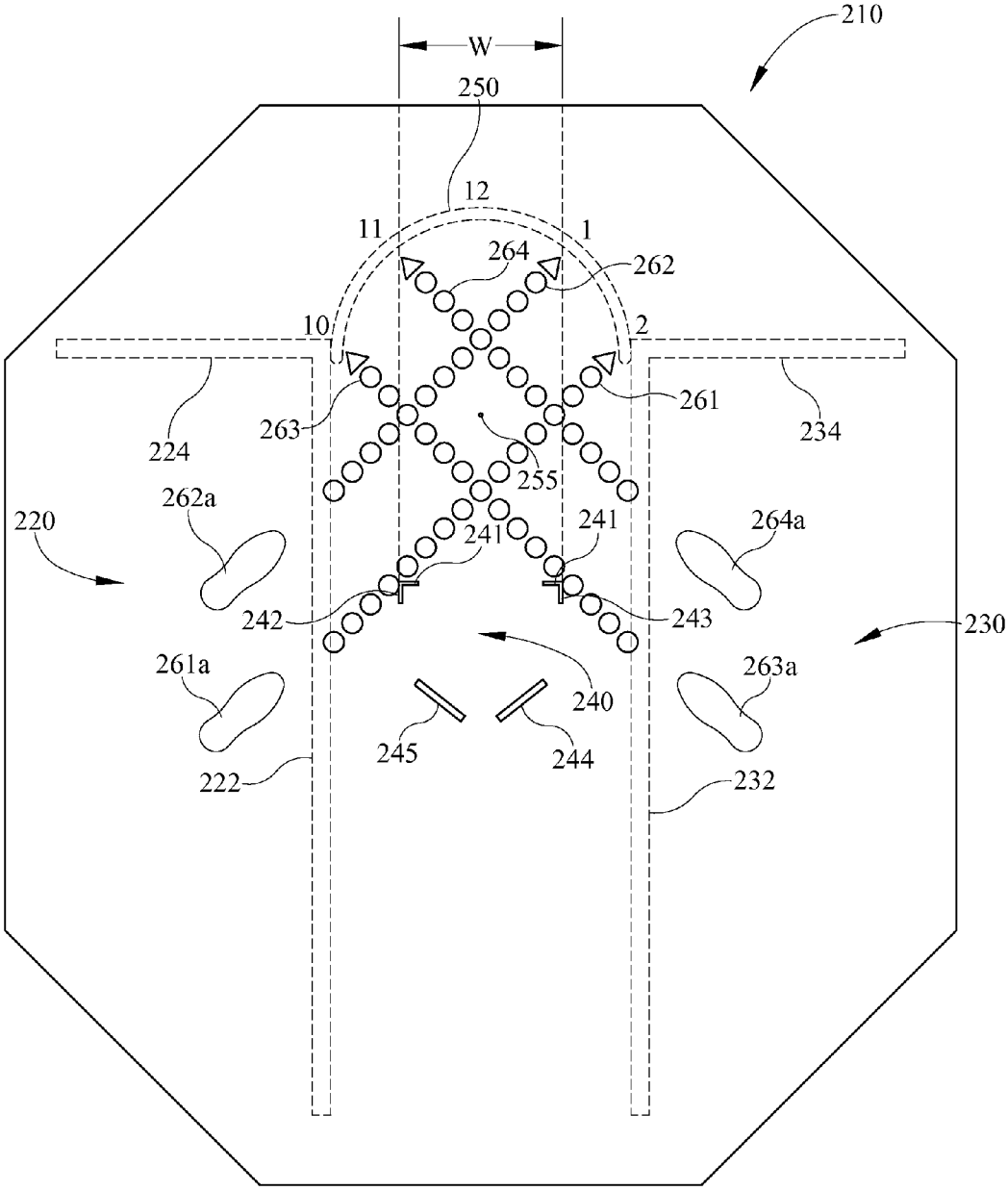
FIG. 3 illustrates a third embodiment of an apparatus for teaching bunting techniques.

Although the first line 61, second line 62, third line 63, and fourth line 64 are depicted as continuous common width lines herein, one or more of the lines 61, 62, 63, and 64 may take on other forms in alternative embodiments. For example, one or more of the lines 61, 62, 63, and 64 may be dashed or otherwise discontinuous. Also, for example, as shown in FIG. 3, one or more of the lines 61, 62, 63, and 64 may have one or more distinct widths such as, for example, an arrow at the forward end thereof or a shoe mark provided at the end of each of the lines 61, 62, 63, and 64 where they extend, respectively, into the right-handed batter's box 20 and the left-handed batter's box 30. Other lines described herein such as, for example, the lines comprising the right-handed batter's box 20, the left-handed batter's box 30, the home plate 40, and/or the arc line 50 may also take on other forms in alternative embodiments. The term "fiducial marking" may be used herein to refer broadly to any such lines described herein and to other markings that may be understood by a user to be a standard of reference. For example, the term fiducial marking shall include, without limitation, one or more shapes, symbols and/or objects that may be understood by a user to be a standard of reference.

Also, although the mat 10 is depicted with a right-handed batter's box 20, a left-handed batter's box 30, a home plate 40, and an arc line 50, one or more of the items may be omitted in alternative embodiments. For example, in alternative embodiments the home plate 40 may be omitted and the mat 10 may be configured for placement next to a home plate on a baseball field. Also, for example, in some embodiments the right-handed batter's box 20, the left-handed batter's box 30, and/or the arc line 50 may be omitted. Also, although the mat 10 is depicted as a single mat, in alternative embodiments the mat may be divided into a plurality of mat sections that may be placed adjacent to one another. For example, in some embodiments the right-handed batter's box 20 and/or the left-handed batter's box 30 may be provided as separate mat sections. Such a configuration may allow for the spacing between the right-handed batter's box 20 and/or the left-handed batter's box 30 to be adjusted to conform to desired dimensions.

Figure 2:
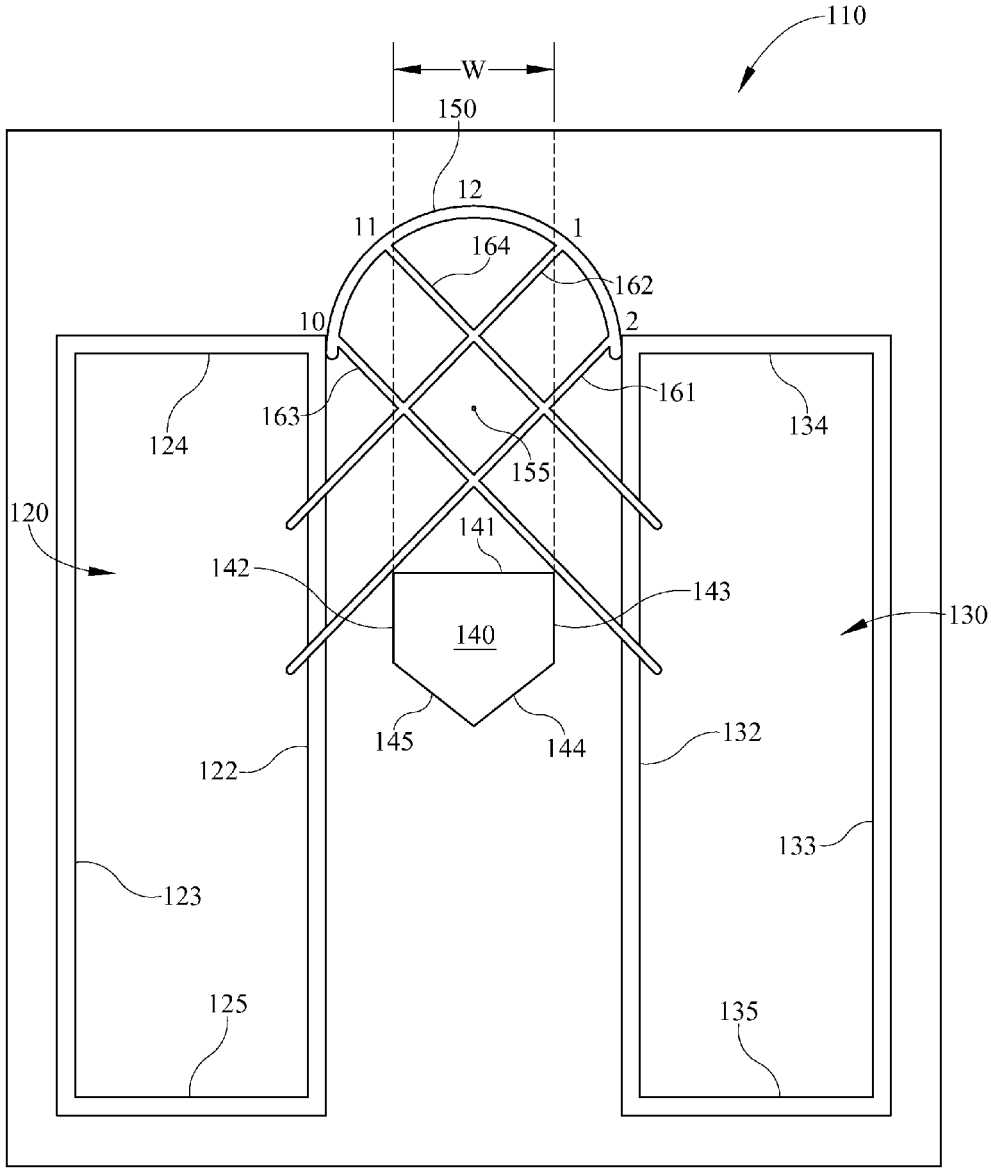
FIG. 2 illustrates a second embodiment of an apparatus for teaching bunting techniques.

Referring now to FIG. 2, a second embodiment of an apparatus for teaching bunting techniques is shown. The apparatus includes a mat 110 that is larger than the first embodiment of the mat 10 and includes a full right-handed batter's box 120 and a full left-handed batter's box 130. The right-handed batter's box 120 has a right-handed interior line 122, a right-handed exterior line 123, a right-handed front line 124 joining the right-handed interior line 122 and right-handed exterior line 123, and a right-handed back line 125 joining the right-handed interior line 122 and right-handed exterior line 123. The left-handed batter's box 130 has a left-handed interior line 132, a left-handed exterior line 133, a left-handed front line 134 joining the left-handed interior line 132 and left-handed exterior line 133, and a left-handed back line 135 joining with the left-handed interior line 132 and left-handed exterior line 133.

A first line 161 and a second line 162 extend from within the right-handed batter's box 120 in a generally forward right direction generally toward the left-handed batter's box 130, each being at approximately a forty-five degree angle with respect to the front side 141 of a home plate 140. The first line 161 passes adjacent a left intersection of the front side 141 and left side 142 of the home plate 140. The first line 161 terminates adjacent the intersection between the left-handed interior line 132 and the left-handed front second direction line 134. With respect to a clock center point 155 spaced forward of the home plate 140, the first line 161 runs generally in a seven o'clock to two o'clock orientation. The first line 161 may be referenced as a two o'clock line herein and the mat 110 may optionally include the numeral "2" at a forward end of the first line 161, as depicted in FIG. 2.

In the depicted embodiment of FIG. 2, the second line 162 and the first line 161 are parallel with one another and the second line 162 is more distal the home plate 140 than the first line 161. The second line 162 extends from within the right-handed batter's box 120 in a forward right direction toward a location forward of the left-handed batter's box 130. With respect to the clock center point 155, the second line 162 runs generally in an eight o'clock to one o'clock orientation. The second line 162 may be referenced as a one o'clock line herein and the mat 10 may optionally include the numeral "1" at a forward end of the second line 162, as depicted in FIG. 2. In alternative embodiments the first line 161 and second line 162 may at a non-parallel angle with respect to one another and/or either may be at an alternative angle with respect to the front side 141 of home plate 140.

A third line 163 and a fourth line 164 extend from within the left-handed batter's box 130 in a generally forward left direction generally toward the right-handed batter's box 120, each at approximately a forty-five degree angle with respect to the front side 141 of the home plate 140. The third line 163 passes adjacent a right intersection of the front side 141 and the right side 143 of the home plate 140. The third line 163 terminates adjacent the intersection between the right-handed interior line 122 and the right-handed front line 124. With respect to the clock center point 155, the third line 163 runs generally in a five o'clock to ten o'clock orientation. The third line 163 may be referenced as a ten o'clock line herein and the mat 110 may optionally include the numeral "10" at a forward end of the third line 163, as depicted in FIG. 2.

The fourth line 164 extends from within the left-handed batter's box 130 in a forward left direction toward a location forward of the right-handed batter's box. With respect to the clock center point 155, the fourth line 164 runs generally in an eleven o'clock to four o'clock orientation. The fourth line 164 may be referenced as an eleven o'clock line herein and the mat 110 may optionally include the numeral "11" at a forward end of the fourth line 164, as depicted in FIG. 2. In alternative embodiments the third line 163 and fourth line 164 may at a non-parallel angle with respect to one another and/or either may be at an alternative angle with respect to the front side 141 of home plate 140.

In the depicted embodiment an arc line 150 is provided in a forward portion of the mat 110 and extends between a location proximal the intersection between the right-handed first direction interior line 122 and the right-handed front second direction line 124 and the left-handed first direction interior line 132 and the left-handed front second direction line 134. In the depicted embodiment the arc line 150 extends between and connects the first line 161, the second line 162, the third line 163, and the fourth line 164. The arc line 150 may serve as a visual aide to help a batter be appropriately oriented to the first line 161, the second line 162, the third line 163, and the fourth line 164.

Referring again to FIG. 3, a third embodiment of an apparatus for teaching bunting techniques is shown. The apparatus includes a mat 210 that is octagonal in shape and includes a portion of a right-handed batter's box 220 and a portion of a left-handed batter's box 230. The right-handed batter's box 220 has a right-handed interior fiducial marking 222 having a plurality of dashed line segments and a right-handed front fiducial marking 224 having a plurality of dashed line segments. The right-handed front fiducial marking 224 extends left perpendicularly from the right-handed interior fiducial marking 222. The left-handed batter's box 230 has a left-handed interior fiducial marking 232 having a plurality of dashed line segments and a left-handed front fiducial marking 234 having a plurality of dashed line segments. The left-handed front fiducial marking 234 extends right perpendicularly from the left-handed interior fiducial marking 232.

A target 240 is interposed between the right-handed batter's box 220 and the left handed batter's box 230 and has a front fiducial marking 241 having two spaced apart line segments, a right fiducial marking 243 having a single line segment, a left fiducial marking 242 having a single line segment, a right angled fiducial marking 244 having a single line segment, and a left angled fiducial marking 245 having a single line segment.

A first fiducial marking 261 and a second fiducial marking 262 extend from within the right-handed batter's box 220 in a generally forward right direction generally toward the left-handed batter's box 230, each being at approximately a forty-five degree angle with respect to the front fiducial marking 241 of the home plate 240. The first fiducial marking 261 includes a plurality of spaced apart sequential circles, a depiction of a right foot 261*a* on an end thereof inside the right-handed batter's box 220, and an arrow on an opposite end thereof distal the depiction of the right foot. With respect to a clock center point 255 spaced in a forward direction of the home plate 240, the first fiducial marking 261 runs generally in a seven o'clock to two o'clock orientation. The first fiducial marking 261 may be referenced as a two o'clock fiducial marking herein and the mat 210 may optionally include the numeral "2" at a forward end of the first fiducial marking 261, as depicted in FIG. 3. In alternative embodiments the first fiducial marking 261 and second fiducial marking 262 may at a non-parallel angle with respect to one another and/or may be at an alternative angle with respect to the front fiducial marking 241 of home plate 240.

The second fiducial marking 262 includes a plurality of spaced apart sequential circles, a depiction of a left foot 262*a* on an end thereof inside the right-handed batter's box 220, and an arrow on an opposite end thereof distal the depiction of the left foot. With respect to the clock center point 255, the second fiducial marking 262 runs generally in an eight o'clock to one o'clock orientation. The second fiducial marking 262 may be referenced as a one o'clock fiducial marking herein and the mat 210 may optionally include the numeral "1" at a forward end of the second fiducial marking 262, as depicted in FIG. 3. In the depicted embodiment of FIG. 2, the second fiducial marking 262 and the first fiducial marking 261 are substantially parallel with one another and the second fiducial marking 262 is more distal the home plate 240 than the first fiducial marking 261.

A third fiducial marking 263 and a fourth fiducial marking 264 extend from within the left-handed batter's box 230 in a generally forward left direction generally toward the right-handed batter's box 220, each at approximately a forty-five degree angle with respect to the front side 241 of the home plate 240. The third fiducial marking 263 includes a plurality of spaced apart sequential circles, a depiction of a left foot 263*a* on an end thereof inside the left-handed batter's box 230, and an arrow on an opposite end thereof distal the depiction of the left foot. With respect to the clock center point 255, the third fiducial marking 263 runs generally in a five o'clock to ten o'clock orientation. The third fiducial marking 263 may be referenced as a ten o'clock fiducial marking herein and the mat 210 may optionally include the numeral "10" at a forward end of the third fiducial marking 263, as depicted in FIG. 3. In alternative embodiments the third fiducial marking 263 and fourth fiducial marking 264 may at a non-parallel angle with respect to one another and/or may be at an alternative angle with respect to the front fiducial marking 241 of home plate 240.

The fourth fiducial marking 264 includes a plurality of spaced apart sequential circles, a depiction of a right foot 264*a* on an end thereof inside the left-handed batter's box 230, and an arrow on an opposite end thereof distal the depiction of the left foot. With respect to the clock center point 255, the fourth fiducial marking 264 runs generally in an eleven o'clock to four o'clock orientation. The fourth fiducial marking 264 may be referenced as an eleven o'clock fiducial marking herein and the mat 210 may optionally include the numeral "11" at a forward end of the fourth fiducial marking 264, as depicted in FIG. 3.

Figure 4:
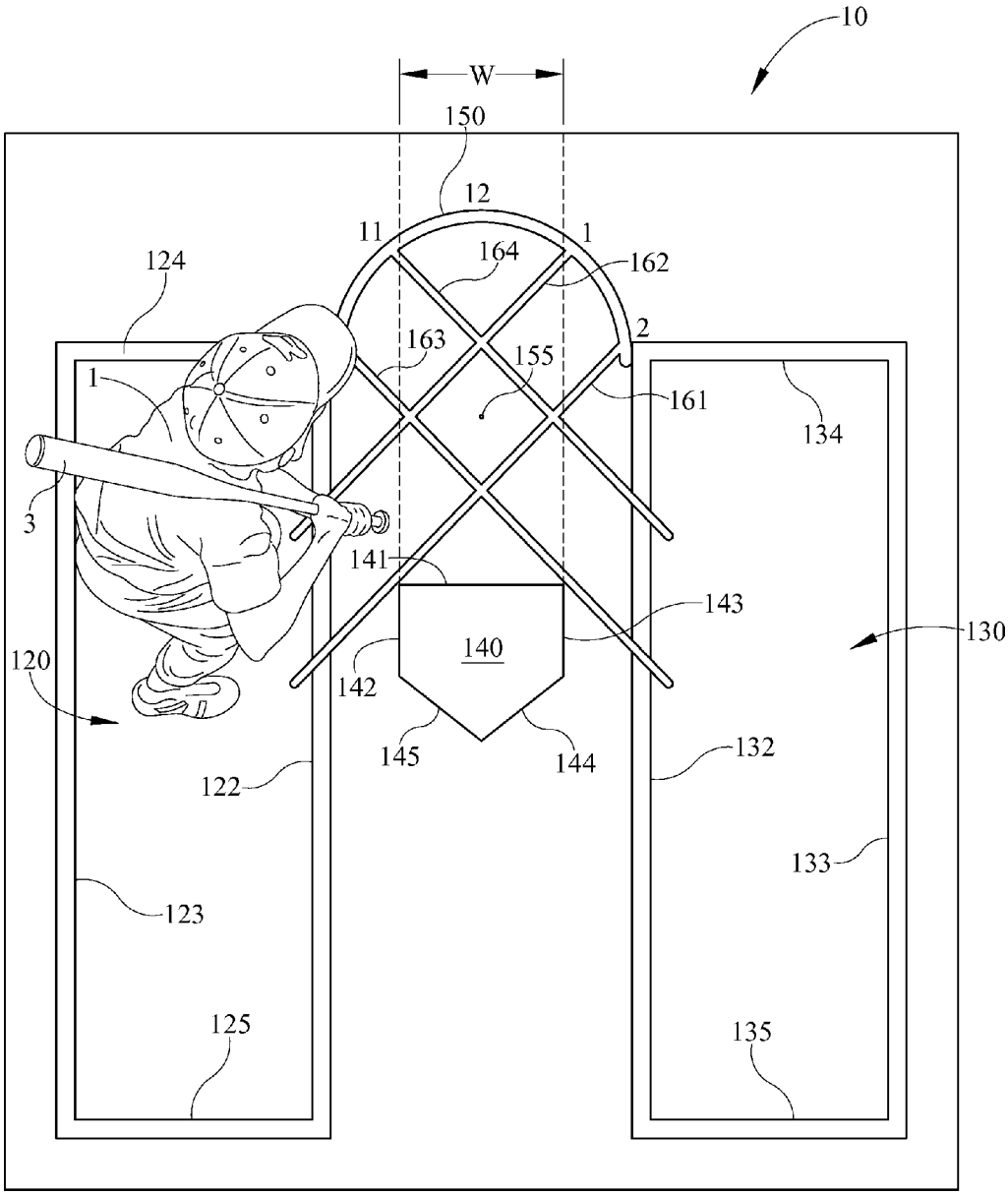
FIG. 4 illustrates the apparatus of FIG. 2 and a right-handed player with a bat; the player and bat are positioned in a non-bunting stance.
Figure 5:
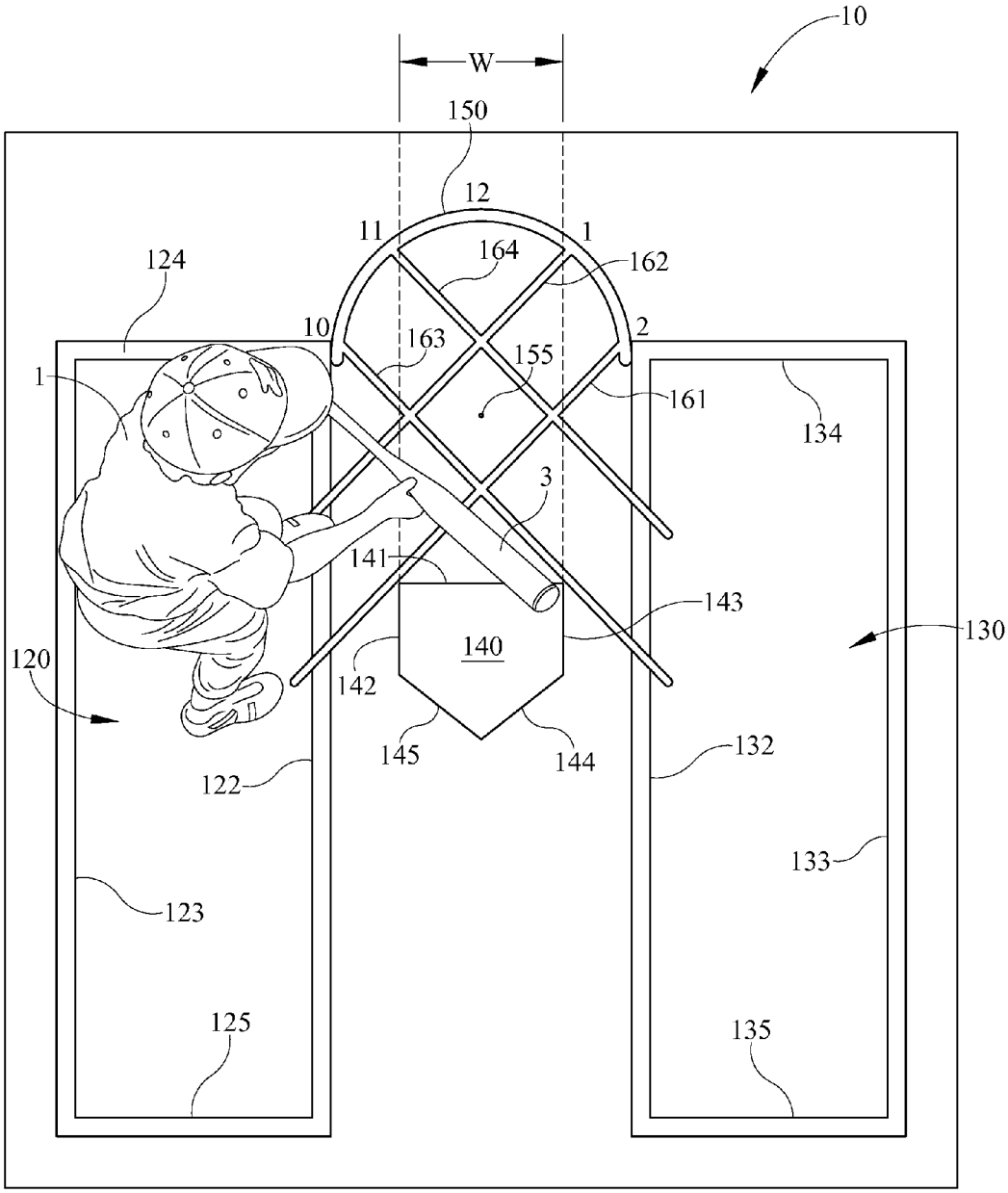
FIG. 5 illustrates the apparatus of FIG. 2 and a right-handed player with a bat; the player and bat are positioned for bunting toward first base.
Figure 6:
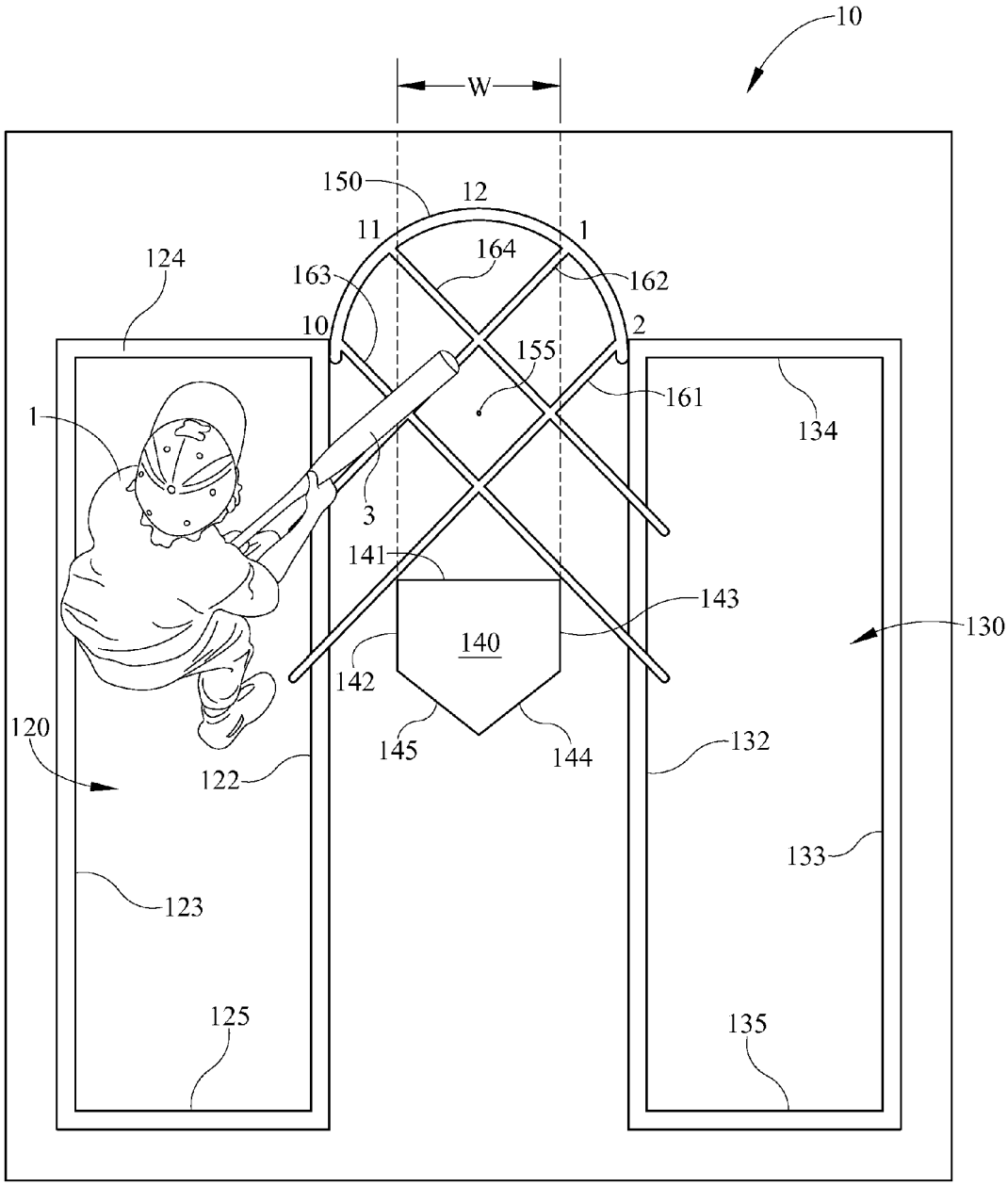
FIG. 6 illustrates the apparatus of FIG. 2 and a right-handed player with a bat; the player and bat are positioned for bunting toward third base.

Referring now to FIGS. 4 through 6, reference will be made to a player 1 in a right-handed stance holding a bat 3 to describe how mat 10, mat 110, and/or mat 210 may be utilized for teaching bunting techniques. Prior to preparing to bunt, the player 1 may be in a batting stance with his or her feet generally facing the right direction and with the bat 3 cocked over his or her shoulder, such as depicted, for example, in FIG. 4.

Regardless of where the player 1 is positioned initially in the right-handed batter's box 120, the player 1 may prepare for a bunt by pivoting or rotating his hips so that the feet of the player 1 are in bunting position, such as depicted in FIGS. 5 and 6. Namely, the front foot of the player 1 is pointing along the second line 162 toward the numeral "1" located adjacent the arc line 150 and the back foot of the player 1 is pointing along the first line 161 toward the numeral "2" located adjacent the arc line 150. The player 1 may be instructed to position himself for a bunt as soon as the ball leaves the pitcher's hand and to hold the bat 3 at the highest point of the strike zone at a forty-five degree angle. The player 1 may be instructed to utilize his bottom hand as a steering mechanism for the bat 3 and to pinch the bat with his top hand. If the pitched ball is outside of the strike zone, the player 1 may be instructed to pull the bat 3 back away from the home plate 40.

To bunt in the direction of first base, the player 1 may be instructed to use his bottom hand to position the bat 3 substantially parallel with the third line 163 and/or the fourth line 164, as shown, for example, in FIG. 5. The player 1 may be instructed to ideally bunt at a pitch from the middle of the home plate 140 to the outside when bunting in the direction of first base.

To bunt in the direction of third base, the player 1 may be instructed to use his bottom hand to position the bat 3 substantially parallel with the first line 161 and/or the second line 162 as shown, for example, in FIG. 6. The player 1 may be instructed to ideally bunt at a pitch from the middle of the home plate 140 inward when bunting in the direction of third base. The player 1 may also be instructed not to reach to bunt the ball or to roll his top hand in order to bunt an outside pitch. The player 1 may also be instructed to keep his hands closer to his body for better control of the bat 3.

Figure 7:
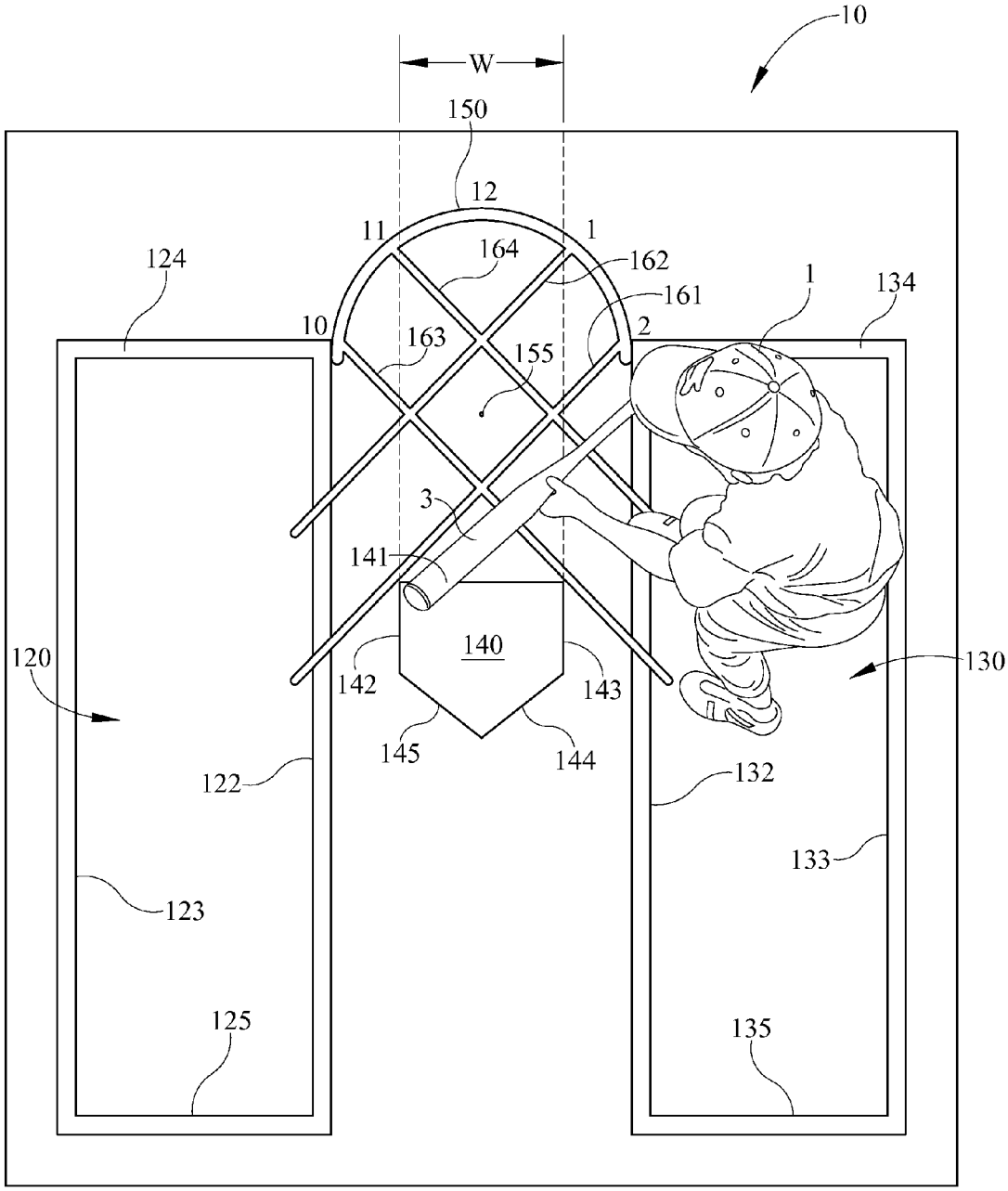
FIG. 7 illustrates the apparatus of FIG. 2 and a left-handed player with a bat; the player and bat are positioned for bunting toward third base.
Figure 8:
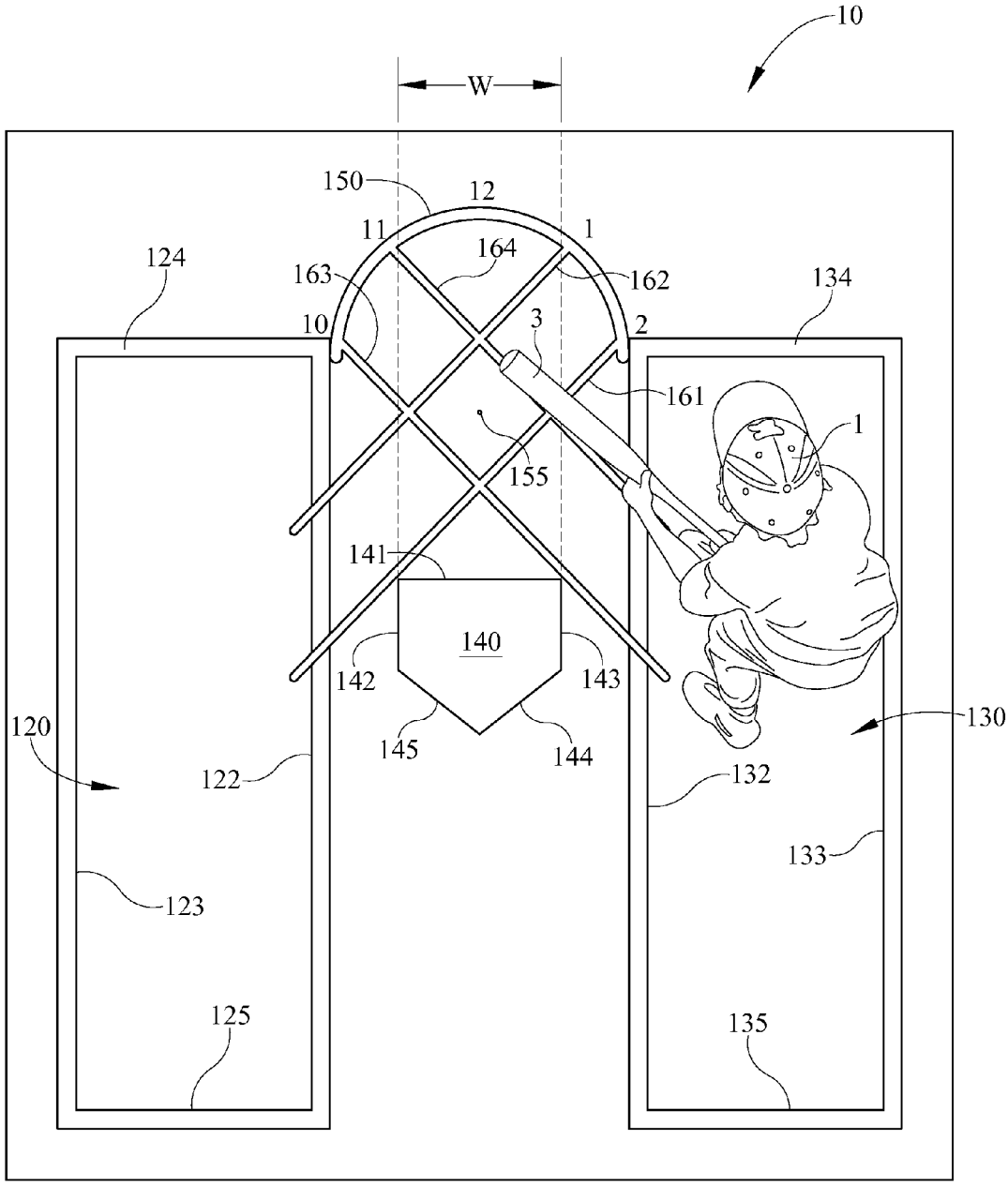
FIG. 8 illustrates the apparatus of FIG. 2 and a left-handed player with a bat; the player and bat are positioned for bunting toward first base.

Referring now to FIGS. 7 and 8, the player 1 in a left-handed stance may similarly be instructed to align his or her front foot with the fourth line 164 and his or her rear foot with the third line 163 when moving into bunting position. The player 1 in a left-handed stance may be instructed to position the bat 3 substantially parallel with the first line 161 and/or the second line 162 to bunt toward third base such as shown, for example, in FIG. 7. The player 1 in a left-handed stance may be instructed to position the bat 3 substantially parallel with the third line 163 and/or the fourth line 164 to bunt toward first base as shown, for example, in FIG. 8. The mat 10, mat 110, and/or mat 210 may be used to teach various types of bunts such as, for example, the sacrifice bunt, the drag bunt/bunting for a base hit, the push bunt, the squeeze bunt, and the fake bunt and slash.

Figure 9:
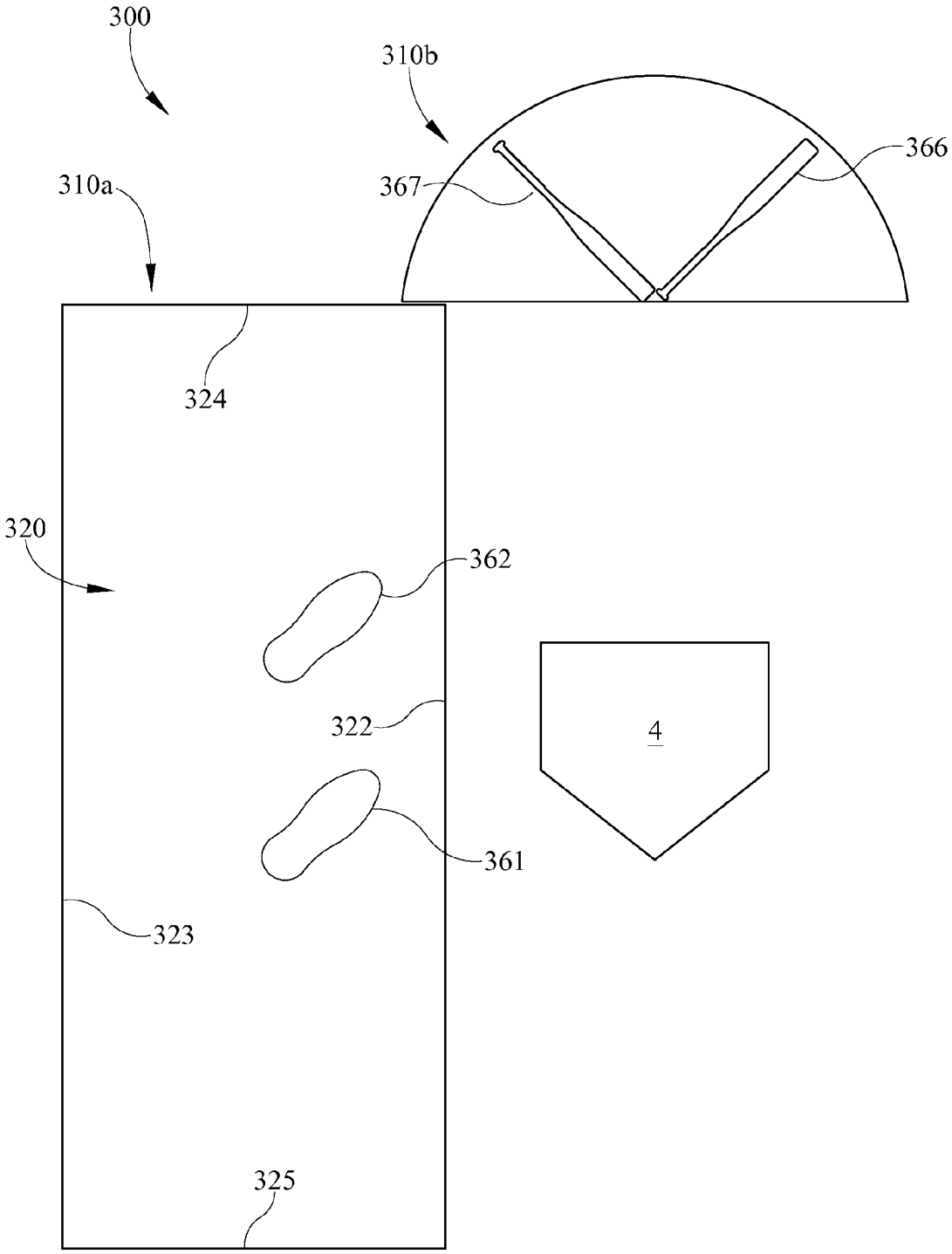
FIG. 9 illustrates a fourth embodiment of an apparatus for teaching bunting techniques.

Referring now to FIG. 9, a fourth embodiment of an apparatus for teaching bunting techniques is shown. The apparatus includes a first mat 310*a* and a second mat 310*b* placed about a home plate 4. The first mat 310*a* defines a batter's box and has a batter's box interior boundary 322 and a batter's box exterior boundary 323 opposite the interior boundary 322. The first mat 310*a* also includes a batter's box front boundary 324 that is substantially perpendicular to the batter's box interior boundary 322 and a batter's box rear boundary 325 opposite the batter's box front boundary. A first fiducial marking 361 in the shape of a foot is provided adjacent the batter's box interior boundary 322 and is at approximately a forty to fifty degree angle with respect to the batter's box interior boundary 322. A second fiducial marking 362 in the shape of a foot is provided adjacent the batter's box interior boundary 322 and is at approximately a forty to fifty degree angle with respect to the batter's box interior boundary 322. The second fiducial marking 362 is interposed between the first fiducial marking 361 and the batter's box front boundary 324.

The second mat 310*b* is generally semi-circular in shape. The second mat 310*b* is placed adjacent the first mat 310*a* and has a third fiducial marking 366 in the shape of a bat that is aligned in a substantially parallel relationship with the first fiducial marking 361 and second fiducial marking 362. The second mat 310*b* also has a fourth fiducial marking 367 in the shape of a bat that is substantially perpendicular to the third fiducial marking 366. The third and fourth fiducial markings 366 and 367 are positioned in front of the home plate 4. A right-handed player may be instructed to substantially align his or her feet with first and second fiducial markings 361 and 362 and substantially align his or her bat with third fiducial marking 366 when bunting toward third base. A right-handed player may be instructed to substantially align his or her feet with first and second fiducial markings 361 and 362 and substantially align his or her bat with fourth fiducial marking 367 when bunting toward first base.

In some embodiments a third mat may optionally be provided for a left-handed batter's box. In some embodiments non-fiducially marked portions of the first mat 310*a* and/or the second mat 310*b* may be wholly or partially transparent. For example, portions of the first mat 310*a* may be transparent, thereby allowing the mat 310*a* to be selectively flipped over to serve as either a right-handed batter's box or a left-handed batter's box.

Figure 10:
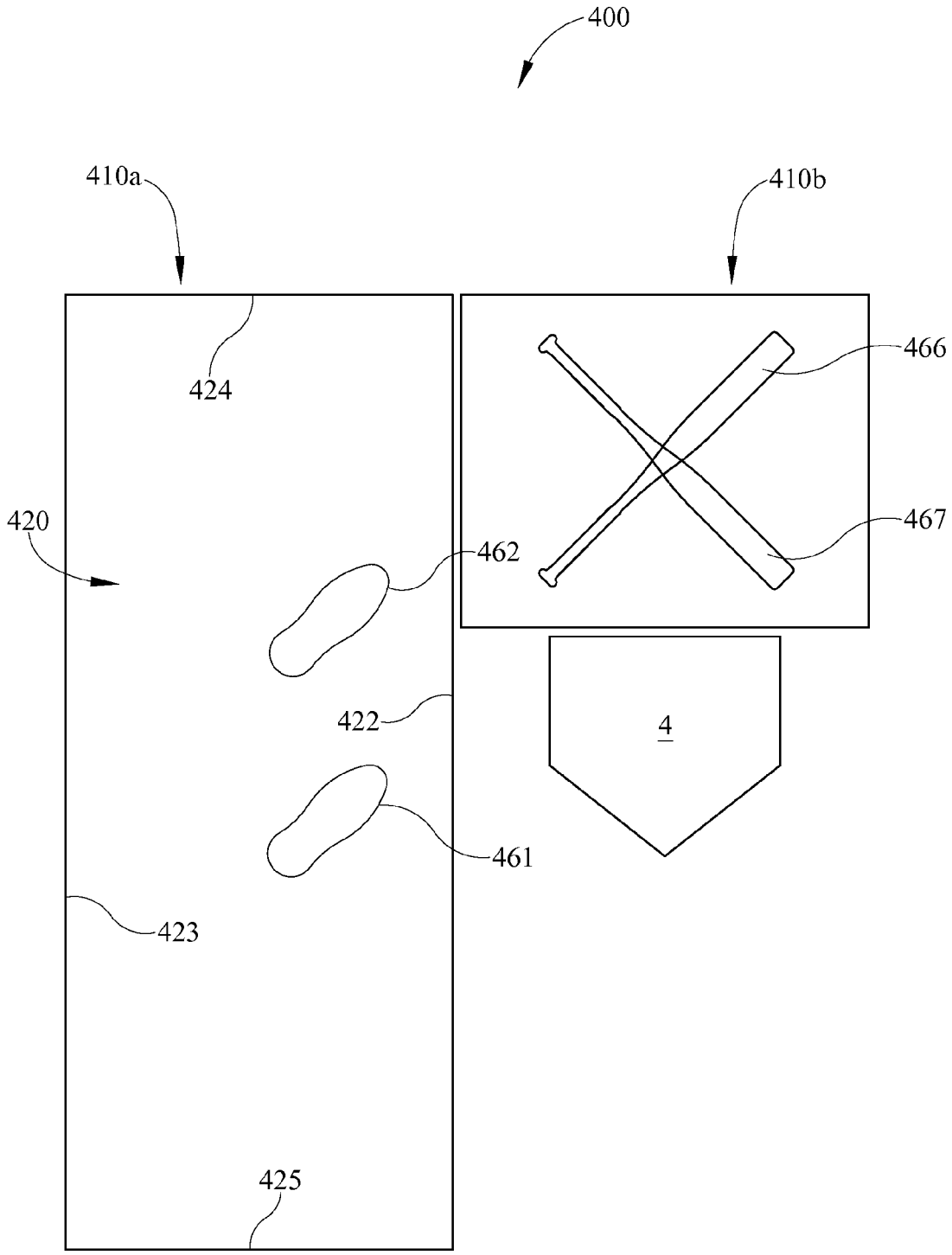
FIG. 10 illustrates a fifth embodiment of an apparatus for teaching bunting techniques.

Referring now to FIG. 10, a fifth embodiment of an apparatus for teaching bunting techniques is shown. The apparatus includes a first mat 410*a* and a second mat 410*b* placed about a home plate 4. The first mat 410*a* is similar to first mat 310*a* and defines a batter's box having a batter's box interior boundary 422, a batter's box exterior boundary 423 opposite the interior boundary 422, a batter's box front boundary 424 that is substantially perpendicular to the batter's box interior boundary 422 and a batter's box rear boundary 425 opposite the batter's box front boundary. First fiducial marking 461 and second fiducial marking 462 are each in the shape of a foot and are each provided adjacent the batter's box interior boundary 422 at approximately a forty to fifty degree angle with respect to the batter's box interior boundary 422.

The second mat 410*b* is generally square in shape. The second mat 410*b* is placed adjacent the first mat 410*a* and has a third fiducial marking 466 in the shape of a bat that is aligned in a substantially parallel relationship with the first fiducial marking 461 and second fiducial marking 462. The second mat 410*b* also has a fourth fiducial marking 467 in the shape of a bat that is substantially perpendicular to the third fiducial marking 466. The third and fourth fiducial markings 466 and 467 are positioned in front of the home plate 4. A right-handed player may be instructed to substantially align his or her feet with first and second fiducial markings 461 and 462 and substantially align his or her bat with third fiducial marking 466 when bunting toward third base. A right-handed player may be instructed to substantially align his or her feet with first and second fiducial markings 461 and 462 and substantially align his or her bat with fourth fiducial marking 467 when bunting toward first base. In some embodiments a third mat may optionally be provided for a left-handed batter's box. In some embodiments non-fiducially marked portions of the first mat 410*a* and/or the second mat 410*b* may be wholly or partially transparent.

Figure 11:
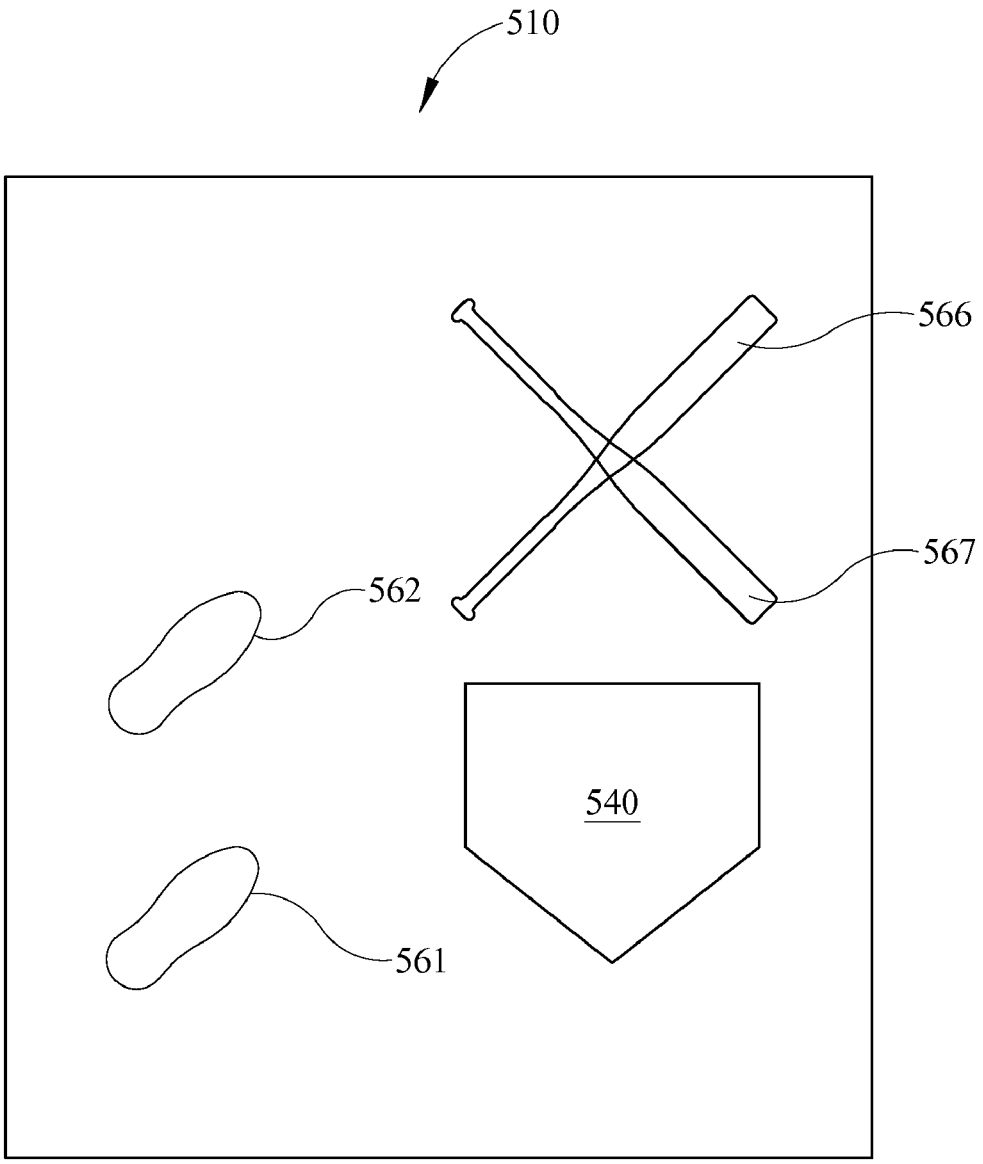
FIG. 11 illustrates a sixth embodiment of an apparatus for teaching bunting techniques.

Referring now to FIG. 11, a sixth embodiment of an apparatus for teaching bunting techniques is shown. The apparatus includes a mat 510 that is similar to mats 410*a* and 410*b*. The mat 510 includes a first fiducial marking 561 in the shape of a foot and interposed between a left side of the mat 510 and a home plate 540. The first fiducial marking 561 is oriented at approximately a forty to fifty degree angle with respect to the front side of the home plate 540. A second fiducial marking 562 in the shape of a foot is provided interposed between the first fiducial marking 561 and a front side of the mat 510. The second fiducial marking 562 is at approximately a forty to fifty degree angle with respect to the front side of the home plate 540. A third fiducial marking 566 in the shape of a bat is aligned in a substantially parallel relationship with the first fiducial marking 561 and second fiducial marking 562. A fourth fiducial marking 567 in the shape of a bat is substantially perpendicular to the third fiducial marking 566. The third and fourth fiducial markings 566 and 567 are positioned in front of the home plate 4.

In some embodiments non-fiducially marked portions of the mat 510 may be wholly or partially transparent and the mat may be selectively flipped over to serve as either a right-handed batter's box or a left-handed batter's box. In some embodiments the left side of the mat may be moved in closer to the home plate 540 such that only toe portions of the first fiducial marking 561 and second fiducial marking 562 are visible. Such a configuration may allow for a player to properly align his or her feet with the first fiducial marking 561 and second fiducial marking 562, but still have all or portions of his or her feet off the mat. For example, only the player's toes may be provided on the mat 510. Also, for example, the player's toes may be positioned immediately adjacent the mat 510. Such a configuration may prevent movement of the mat and/or may enable all or portions of a player's feet to be positioned on a surface besides the mat such as, for example, dirt or grass.

Figure 12:
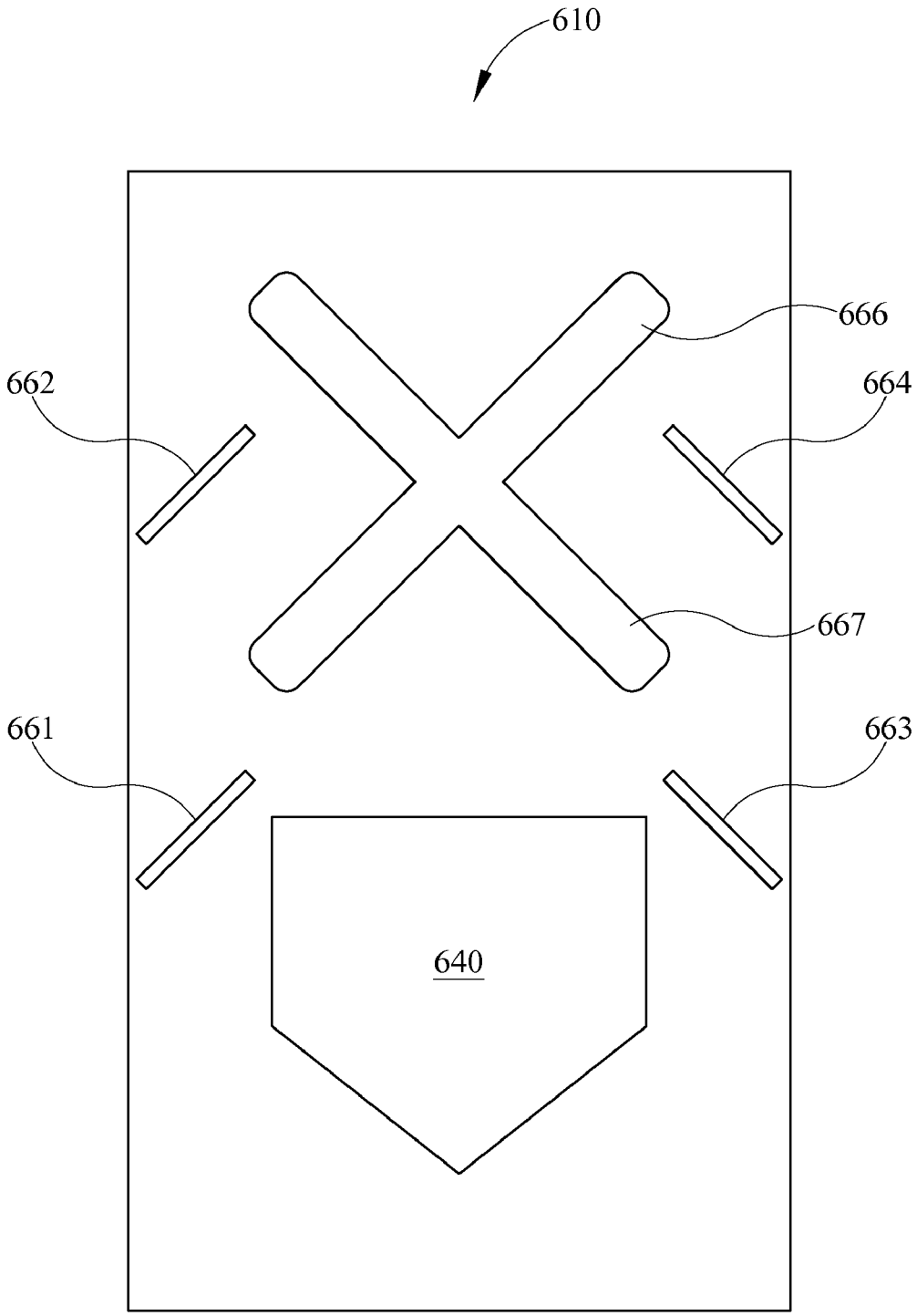
FIG. 12 illustrates a seventh embodiment of an apparatus for teaching bunting techniques.

Referring now to FIG. 12, a seventh embodiment of an apparatus for teaching bunting techniques is shown. The apparatus includes a mat 610 that has a first fiducial marking 661 and a second fiducial marking 662 that are provided adjacent a left side of the mat 610. The first fiducial marking 661 and second fiducial 662 are provided for a player, standing adjacent the left side of the mat, to align his or her feet therewith. The mat 610 also has a third fiducial marking 663 and a fourth fiducial marking 664 that are provided adjacent a right side of the mat 610. The third fiducial marking 663 and fourth fiducial marking 664 are provided for a player, standing adjacent the right side of the mat, to align his or her feet therewith. Each of the fiducial markings 661, 662, 663, and 664 are at approximately a forty to fifty degree angle with respect to the front side of the home plate 640.

A fifth fiducial marking 666 is aligned in a substantially parallel relationship with the first fiducial marking 661 and second fiducial marking 662. A sixth fiducial marking 667 intersects with the fifth fiducial marking 666 and is aligned in a substantially parallel relationship with the third fiducial marking 663 and fourth fiducial marking 664. The fifth and sixth fiducial markings 666 and 667 are positioned in front of the home plate 640. A right-handed player may be instructed to substantially align his or her feet with first and second fiducial markings 661 and 662 and substantially align his or her bat with fifth fiducial marking 666 when bunting toward third base. A right-handed player may be instructed to substantially align his or her feet with first and second fiducial markings 662 and 661 and substantially align his or her bat with sixth fiducial marking 667 when bunting toward first base.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

I claim:

1. An apparatus for teaching bunting techniques, the apparatus comprising:

a first mat and a second mat;

said first mat defining a batter's box and having a batter's box interior boundary, a batter's box front boundary substantially perpendicular to said batter's box interior boundary, a first fiducial marking adjacent said batter's box interior boundary and at approximately a forty to fifty degree angle with respect to said batter's box interior boundary, and a second fiducial marking adjacent said batter's box interior boundary, said second fiducial marking interposed between said first fiducial marking and said batter's box front boundary and in a substantially parallel relationship with said first fiducial marking;

said second mat configured for placement adjacent said first mat and having a third fiducial marking and a fourth fiducial marking substantially perpendicular to said third fiducial marking; wherein said third fiducial marking is alignable in a substantially parallel relationship to said first fiducial marking and said second fiducial marking when said second mat is placed adjacent said first mat.

2. The apparatus of claim 1 wherein at least potions of said first mat are transparent.

3. The apparatus of claim 1 wherein said second mat is generally semi-circular in shape.

4. The apparatus of claim 1 wherein said first fiducial marking includes a plurality of sequential substantially aligned shapes.

5. The apparatus of claim 1 further comprising a target provided on said first mat.

6. The apparatus of claim 1 further comprising a target provided on said second mat.

7. An apparatus for teaching bunting techniques, the apparatus comprising:

a mat defining a forward direction, a rearward direction opposite said forward direction, a right direction perpendicular to said forward direction and said rearward direction, and a left direction opposite said right direction;

at least a portion of a batter's box on said mat, said batter's box having a front fiducial marking generally oriented in a left to right direction;

a first foot alignment fiducial marking on said batter's box in a rearward direction from said front fiducial marking, said first foot alignment fiducial marking oriented generally in said forward direction and said right direction at approximately a forty to fifty degree angle with respect to said front fiducial marking;

a second foot alignment fiducial marking on said batter's box interposed between said front fiducial marking and said first foot alignment fiducial marking, said second foot alignment fiducial marking oriented generally in said forward direction and said right direction at approximately a forty to fifty degree angle with respect to said front fiducial marking;

a first bat alignment fiducial marking on said mat in said right direction from said first foot alignment fiducial marking, said first bat alignment fiducial marking in a substantially parallel relationship with respect to said first foot alignment fiducial marking and said second foot alignment fiducial marking;

a second bat alignment fiducial marking on said mat in said right direction from said first foot alignment fiducial marking, said second bat alignment fiducial marking in a substantially perpendicular relationship with said first bat alignment fiducial marking.

8. The apparatus of claim 7 wherein said mat includes a plurality of mat sections configured for placement adjacent one another.

9. The apparatus of claim 7 wherein said first bat alignment fiducial marking is positioned from substantially in-line with said first fiducial marking to substantially in-line with said second fiducial marking.

10. The apparatus of claim 7 wherein at least potions of said mat are transparent.

11. The apparatus of claim 7 wherein said first foot alignment fiducial marking and said second foot alignment fiducial marking are each shaped like a foot.

12. The apparatus of claim 7 wherein first bat alignment fiducial marking and said second bat alignment fiducial marking are each shaped like a bat.

13. An apparatus for teaching bunting techniques, the apparatus comprising:

a first mat and a transparent second mat;

said first mat defining a batter's box and having a batter's box interior boundary, a batter's box front boundary substantially perpendicular to said batter's box interior boundary, a first fiducial marking adjacent said batter's box interior boundary and at approximately a forty to fifty degree angle with respect to said batter's box interior boundary, and a second fiducial marking adjacent said batter's box interior boundary, said second fiducial marking interposed between said first fiducial marking and said batter's box front boundary and in a substantially parallel relationship with said first fiducial marking;

said second mat configured for placement adjacent said first mat and having a third fiducial marking alignable in a substantially parallel relationship to said first fiducial marking and said second fiducial marking when said second mat is placed adjacent said first mat.

14. The apparatus of claim 13 wherein said second mat is generally semi-circular in shape.

15. The apparatus of claim 13 wherein said first fiducial marking includes a plurality of sequential substantially aligned shapes.

16. The apparatus of claim 13 further comprising a target provided on said second mat.

* * * * *